US005372701A

United States Patent [19]

Gerdon et al.

[11] Patent Number: 5,372,701

[45] Date of Patent: Dec. 13, 1994

[54] PROCESS AND APPARATUS FOR ELECTROPLATING

[76] Inventors: Louis J. Gerdon, 338 E. 3rd, Deer Park, N.Y. 11729; James R. Worth, 3 Cresent Dr., Brentwood, N.Y. 11717

[21] Appl. No.: 801,670

[22] Filed: Dec. 3, 1991

Related U.S. Application Data

[63] Continuation of Ser. No. 494,810, Mar. 14, 1990, abandoned, which is a continuation of Ser. No. 168,891, Mar. 16, 1988, abandoned, which is a continuation-in-part of Ser. No. 118,278, Nov. 6, 1987, abandoned, which is a continuation-in-part of Ser. No. 947,620, Dec. 30, 1986, abandoned.

[51] Int. Cl.[5] ..... C25D 5/34; C25D 5/50; C25D 17/00; C25D 21/16

[52] U.S. Cl. ..... 205/210; 205/220; 205/224; 205/917; 204/141.5; 204/232

[58] Field of Search ..... 205/80, 210, 224, 227, 205/238, 263, 264, 265, 266, 270, 271, 281, 305, 220, 917; 204/DIG. 13, 198, 215, 232, 141.5

[56] References Cited

U.S. PATENT DOCUMENTS

| | | | |
|---|---|---|---|
| 2,606,866 | 8/1952 | Neish | 205/220 X |
| 3,637,467 | 1/1972 | Spatz | 205/100 |
| 4,039,398 | 8/1977 | Furuya | 205/210 |
| 4,155,775 | 5/1979 | Alpaugh et al. | 134/28 |
| 4,561,956 | 12/1985 | Antonelli | 204/232 |
| 4,595,474 | 6/1986 | Greco | 204/232 |
| 4,764,260 | 8/1988 | Gay et al. | 205/181 X |
| 4,772,357 | 9/1988 | Carlson et al. | 134/30 X |

OTHER PUBLICATIONS

"Electroplating Engineering Handbook", A. K. Graham, 1955, pp. 754–757.

*Primary Examiner*—Donald R. Valentine
*Attorney, Agent, or Firm*—Rogers & Wells

[57] ABSTRACT

The invention relates to an improved process and apparatus for electroplating an object and removing the excess electroplating solution from the electroplating object. The improvement comprises performing the electroplating process utilizing an apparatus and in a manner which eliminates all waste rinse solution and which provides substantially complete recovery of the chemicals utilized, but not used up, in the plating process.

45 Claims, 2 Drawing Sheets

PROCESS AND APPARATUS FOR ELECTROPLATING

CROSS REFERENCE TO RELATED APPLICATIONS

This is a continuation of application Ser. No. 07/494,810, filed Mar. 14, 1990, now abandoned which is a continuation of application Ser. No. 07/168,891, filed Mar. 16, 1988, now abandoned, which, in turn, is a continuation-in-part of application Ser. No. 07/118,278, filed Nov. 6, 1987, now abandoned, which, in turn, is a continuation-in-part of application Ser. No. 06/947,620, filed Dec. 30, 1986, now abandoned.

FIELD OF THE INVENTION

The present invention relates generally to an improved process for electroplating and, more particularly, to an improved process for zinc or cadmium electroplating. Such improvements are brought about through the use of a process which eliminates residual plating rinse water and the need to dispose of and/or chemically treat the same, yet which produces plated objects which are of a quality equal or superior to those plated by conventional processes.

The invention also relates to an improved apparatus for use in an electroplating process. The improvements comprise an electroplating apparatus which eliminates several of the components of a conventional apparatus yet provides plated items which are of a quality equal or superior to those plated in conventional apparatus.

BACKGROUND OF THE INVENTION

It is well-known that when a thin layer of a metal is electrolytically deposited on an object, the object may be cosmetically improved to attain a lustrous appearance. Such electrolytic deposition can also provide a protective, non-corrosive coating on the object or can be used to strengthen a debilitated object. The process of coating an object by electrolytic deposition of a metal is typically referred to as electroplating.

Included among the various types of metals or metal alloys which can be electrolytically deposited onto an object are bronze, nickel, copper, zinc, silver, platinum and cadmium.

Electroplating essentially involves immersing the object to be plated into an electrolytic bath which is typically composed of, among other things, an aqueous solution of a metal salt such as, for instance, nickel sulfate, copper sulfate, zinc chloride or cadmium oxide, which supplies the quantities of the metal to be deposited. Alternatively, the metal to be plated can be dissolved in an appropriate acid or base, i.e., HCl, $H_2SO_4$, $HNO_3$, KOH or NaOH, and thereafter used to form the electrolytic bath.

Within the electrolytic bath, the object to be plated is usually the cathode and the metal, e.g., the bronze, copper, nickel, zinc or cadmium being deposited, functions as the anode. As such, when an electric current is passed through the electrolytic bath solution, a layer of the desired metal is deposited onto the object which is immersed therein.

The thickness or thinness of the coated layer is proportionate to the amount of time that the object is permitted to remain in the electrolytic bath solution. Thus, if a thicker coating is desired, the object should be permitted to remain in solution for a time period which exceeds that required for a thinner coating. Those skilled in the art are familiar with the variations which occur between processes and apparatuses when a particular thickness of a particular metal is desired.

The rate of deposition of the metal onto the object is a function of the current and voltage applied between the cathode and anode. The rate of deposition between processes and apparatuses for a particular metal and the rate of deposition desired are within the knowledge of those skilled in the art or can be ascertained with little or no experimentation.

Once the object has been coated with a layer of metal, the residual chemicals which remain are rinsed off the electroplated object in some manner in order to prepare the object for subsequent treatment and use. The rinse solution which is used usually consists of water or, after continued use of the process and apparatus, a mixture of water and those chemicals used in the electroplating solution. The concentration of the chemicals in the rinse solution is normally maintained at a concentration which is dilute with respect to the electroplating bath and, usually, substantially more dilute than the concentration of the chemicals in the electroplating bath. The rinse water which remains after rinsing is usually toxic and, as such, must be chemically treated or safely disposed of in some manner.

One known technique for rinsing electroplated objects is generally described in U.S. Pat. Nos. 4,561,956; 3,749,657 and 3,556,970. In each of these disclosures the excess electroplating solution remaining on the coated object is removed by spraying the coated object with a large excess of a rinse solution of water. The effluent which results is typically permitted to drain back into the electroplating tank. Usually there is some treatment of the effluent before it is returned to the electroplating tank.

In another known technique of rinsing electroplated objects, the object is introduced into a plurality of serially arranged rinse tanks to progressively rinse the object. For instance, U.S. Pat. No. 4,379,031 describes an evaporation driven counterflow rinse system and method. The apparatus includes a treatment tank and at least a first and final rinse tank. The treatment tank is adapted to be filled to a predetermined level with a treating solution to which workpieces are submerged for treatment. The first and final rinse tanks are adapted to be filled to a predetermined level with rinsing solution in which the workpieces are submerged to rinse off the treating solution. The rinse solution flows by gravity from the final rinse tank to the first rinse tank. To replace lost rinse water there is provided a rinsing solution inlet, and to return plating chemicals carried from the plating tank by the workpieces, the rinsing solution flows by gravity from the first rinse tank into the plating tank.

U.S. Pat. No. 3,985,628 describes a process for pollution control in electroplating systems. In accordance with the process, a plated object is rinsed by immersing it in a succession of rinse baths contained in rinse tanks. The rinse water from the rinse tanks is then conducted to a scrubber either directly or by way of a collection tank. The rinse water, to which excess heat from the bath has been added, is contacted with an air stream in the scrubber to effect the transfer of the chemical values from the air to the rinse water and to effect the transfer of water and heat from the rinse water to the air. The chemically treated and enriched rinse water is then added to the plating bath.

U.S. Pat. No. 3,928,146 describes an electroplating recovery process. After the objects are plated, they are dipped in the pre-rinse portion of a dual chamber tank, and thereafter passed through a series of rinse tanks to substantially remove all plating chemicals from the objects. The solution in the dual chamber tank contains no more than one-half the amount of chemicals carried over into the rinse tanks. Solution in the various rinse tanks is treated by reverse osmosis to remove chemicals, some solution being returned to other rinse tanks. The concentrate from treatment of the solution in the first rinse is placed in a holding tank. This solution is itself passed through a reverse osmosis unit, the permeate being returned to a rinse tank, the concentrate to the holding tank. Periodically, the contents of the holding tank are returned to the plating bath.

U.S. Pat. No. 3,761,381 describes a plating waste recovery unit wherein the rinse liquid resulting from one of a plurality of wash tubs, into which plated objects are dipped successively to rinse off the plating solution, is circulated through an ion exchange column, where it passes through a resin layer that removes chromic acid and other impurities before the liquid is returned to the wash tub.

U.S. Pat. No. 3,616,437 describes a plating apparatus with recovery of plating chemicals from rinse waters. The apparatus provides a plurality of wash tubs that are connected in series with a plating tank. After the time in which a predetermined number of objects have been plated, the water contained in the tub positioned closest to the plating tank is pumped into a heating and concentrating tower, wherein it is heated and concentrated to the level equivalent to that of the plating solution contained in the plating tank. After such treatment, the water is then transferred into the plating tank.

U.S. Pat. No. 3,542,651 describes a unit for the recovery of plating solution. A plurality of wash tubs are provided into which plated articles are dipped successively to rinse off the plating solution. The water from the tub, into which the articles are first dipped, is sucked into a tower heated by steam to concentrate the tub water to plating strength, and this water is returned to the plating tank.

U.S. Pat. No. 3,663,397 describes a method for the treatment of an electrodeposition bath by controlling the electrodeposition bath composition. Thus, a selective membrane is employed in conjunction with a rinsing process to remove dragout from an electrodeposited object. A portion or all of the rinse material resulting therefrom is returned to the electrodeposition bath.

Finally, U.S. Pat. Nos. 3,663,404 and 3,663,399, each describe a method for treating an electrodeposition bath. The two described methods are similar and essentially include a rinsing step employing, as a rinsing agent, at least a portion of the effluent obtained from a selective separation process, such as an ultrafiltration process.

In addition to the post-plating rinses employed in the electroplating processes and apparatuses of the prior art, there are rinse treatments employed with the pre-plating process steps typically utilized in an electroplating process and apparatus.

One typical pre-plating step is a hot electroclean step. This step comprises immersing the object to be plated in a heated basic or caustic solution, e.g. NaOH or KOH, and passing an electric current therethrough. The hot electroclean bath is typically a "flowing type" bath, i.e. having water flowing in and electroclean solution flowing out. To maintain the composition of the bath, base is added periodically or continuously to the bath.

Once the object to be plated has been electrocleaned, in the usual electroplating process and apparatus the item is immersed in a flowing type rinse bath or series of rinse baths to remove substantially all of the excess base.

After immersion in the post-electroclean rinse bath, the object to be plated is immersed in an acid activator bath. In a zinc plating process, the acid activator bath is usually comprised of a solution of HCl (hydrochloric acid) while in a cadmium plating process, the acid activator bath is usually comprised of a solution of $H_2SO_4$ (sulfuric acid). The acid activator bath serves to partly or entirely neutralize any remaining base on the plated object and to activate the surface of the object for subsequent plating.

Once the object to be plated has been immersed in the acid activator bath, the object is usually again immersed in a flowing type rinse bath or series of rinse baths.

The costs associated ,with chemical treatment, disposal and transportation of the various rinse waters to a disposal site are substantial and pose a serious difficulty to an electroplating installation. Another serious difficulty associated with disposing of the rinse water is its negative impact on the environment and on the people who live within the proximity of these waste disposal sites.

Thus, as evidenced by those disclosures discussed hereinabove, which are incorporated herein by reference, there have been attempts to minimize the amounts of contaminated rinse water effluent in electroplating operations.

While these attempts have been partially successful, they often involve huge expenditures of money due to the need to set up a plurality of rinsing tanks.

In addition, because the contaminated rinse water must be treated in some manner before it is returned to the electroplating bath to prevent contamination of the bath, additional costs are associated with this rinse water treatment. Such treatment has necessitated the use of separate rinse water treatment apparatus at electroplating installations.

Accordingly, it is an object and advantage of the present invention to provide an improved process and apparatus for metal electroplating, and especially bronze, nickel, copper, zinc, platinum, silver and cadmium electroplating, which substantially eliminate the necessity to dispose of any waste rinse water resulting from the electroplating process. The process and apparatus of the presently claimed invention is substantially "self-contained", as that term is defined below.

It is another object and advantage of the present invention to provide an improved process and apparatus for metal electroplating, and especially bronze, nickel, copper, zinc, platinum, silver and cadmium plating, which eliminate the need for and costs associated with the treatment and/or disposal of the electroplating rinse water.

It is further object and advantage of the present invention to provide an improved process and apparatus for metal electroplating, and especially bronze, nickel, copper, zinc, platinum, silver and cadmium plating, which eliminate any negative impact that the electroplating waste rinse water has on the environment.

SUMMARY OF THE INVENTION

In accordance with the foregoing objects and advantages, one aspect of the present invention provides an improved process for electroplating a metal onto an object by eliminating the post-electroplating flowing type rinse bath or series of rinse baths.

The improvement to the process and apparatus comprises, in one embodiment, immersing the object in a single, "stagnant" rinse bath. As used herein, the term "stagnant" has its usual meaning, i.e. having no current or flow. The term "stagnant" also encompasses those embodiments of the present invention in which solution from the single rinse bath is returned, without treatment, intermittently to the electroplating bath and/or water or other diluent is added intermittently to the single, stagnant rinse bath. The solution in the single, stagnant rinse bath may or may not be "substantially identical", as that term is defined below, to the electroplating bath.

In an alternative embodiment, the improvement to the process and apparatus comprises immersing the object in a single rinse bath in which the chemical composition of the single rinse bath is "substantially identical" to the electroplating bath. In this embodiment, the rinse bath may be returned, without treatment, intermittently or continuously through suitable means to the electroplating bath. In its broadest aspects, the term "substantially identical" is taken to include all embodiments wherein one or more or all of the chemicals used in the electroplating bath is present in the rinse bath in an amount of at least about one-half the amount, or more, present in the electroplating bath.

In an especially preferred embodiment, the post-electroplating rinse bath can be eliminated entirely and the residual electroplating solution on the plated part is "recaptured", as explained below.

Thereafter, the plated item is allowed to dry, for example, allowed to drip dry, is spun dry or is dried by heating or by an air stream.

The present invention also provides an improved process and apparatus for electroplating a metal onto an object by eliminating the pre-electroplating flowing type electroclean bath and associated flowing type rinse bath or series of rinse baths.

In this regard, the improvement to the process comprises immersing the object to be plated in a stagnant electroclean bath and thereafter immersing the object to be plated in a post-electroclean single, stagnant rinse bath associated with the electroclean bath. The term "stagnant" is as defined above and solution from the single rinse bath may be returned, without treatment, to the electroclean bath. Thereafter, the object is removed from the post-electroclean rinse bath and immersed directly into an acid activator bath, if one is required or used, without further rinsing.

Further in this regard, another improvement to the process and apparatus comprises immersing the object to be plated into, if one is required or used, an acid activator bath and thereafter immersing the object directly into the electroplating bath without any rinse bath or step between the acid activator bath and the electroplating bath.

As used herein the term "immersing" has its usual meaning, i.e. placing the object to be plated, or which has been plated, partially or completely below the surface of a liquid. The term "immersing" also includes those aspects of the process where the function of a particular step may be effected merely through any contact with the associated bath. For example, in the post-electroclean rinse bath, the acid activator bath and the post-electroplating rinse bath, "immersion" can and does include those embodiments of the invention wherein the object to be plated or which has been plated, respectively, is passed through a flow or spray of the respective stagnant bath. The flow or spray of the respective bath will be obtained by, for example, using circulating means, such as a pump with attached spray means, to spray the object. The effluent from the spray would return directly or through return means to the respective stagnant bath.

Also in accordance with the foregoing objects and advantages, the present invention provides an improved apparatus for electroplating an object by eliminating the post-electroplating flowing type rinse bath or series of rinse baths.

The improvement comprises, in one aspect, having an electroplating bath and associated therewith a single, stagnant rinse bath. The single, stagnant rinse bath immediately following the electroplating bath, in sequence, will be the only post-electroplating rinse bath used in the apparatus. In preferred embodiments, there can be associated with the single, stagnant rinse bath means for returning some of the rinse bath, without treatment, back to the electroplating bath. The means for returning some of the rinse bath back to the electroplating bath are well-known, e.g. a pump with associated delivery means such as piping and the like. In an alternative embodiment, the rinse bath can have associated with it means for circulating the rinse bath above the surface of and back to the bath, e.g. as a flow or spray of solution from the rinse bath. This permits an alternate "immersion" of the plated item into the rinse bath.

In a preferred embodiment, the post-electroplating rinse bath can be eliminated entirely and the residual electroplating solution on the plated part is "recaptured" as explained below.

In another aspect of the improved apparatus of the present invention, there is a single, stagnant hot electroclean bath and a single, stagnant rinse bath associated therewith. The single, stagnant hot electroclean bath differs from those in the prior art insofar as those of the prior art require the use of means for water, or other diluent, ingress into, and means for solution overflow egress out of, the electroclean bath. Such requirements are eliminated by the present invention.

The rinse bath associated with the electroclean bath is a single, stagnant rinse bath, as defined herein. In prior art embodiments, the rinse bath associated with the electroclean bath is a flowing type single rinse bath or series of rinse baths. In alternative embodiments of the present invention, the post-electroclean rinse bath can have associated with it means for returning some of the rinse bath, without treatment, back to the electroclean bath and/or means for circulating the rinse bath. Both such means are similar to those means described above with respect to the post-electroplating rinse bath.

In yet another aspect of the improved apparatus of the present invention, there is usually an acid activator bath, preceeding the electroplating bath, in which the object to be plated is immersed prior to plating. In the prior art apparatuses, the acid activator bath has associated with it a flowing type rinse bath or series of rinse baths which serve to remove or dilute excess acid activator solution from the object to be plated. It is one of the advantages of the present apparatus discovered that the post-activator rinse bath or series of rinse baths may be eliminated from the plating apparatus and the object to be plated may be immersed in the electroplating bath directly from the acid activator bath, with no adverse affect on the ability of the object to be plated.

DETAILED DESCRIPTION OF THE INVENTION

The object to be electroplated, in accordance with the present invention, can include a variety of alloys and metals. Generally, the plating being applied consists of a different alloy or metal than the object to be plated.

Those skilled in the art are familiar with objects of alloys or metals onto which an alloy or metal may be electroplated. Though the invention will be described in detail with respect to zinc and cadmium plating, the process and apparatus of the present invention is useful in all plating operations, especially in those plating operations wherein the metal to be plated can be described as "cyanide dissolvable", e.g. including the "noble" metals, platinum, gold, palladium, silver and the like, with or without minor adaptations or modifications.

In zinc and cadmium plating operations, any number of high carbon, medium carbon and low carbon steels, nickel steels or other metals to which a nickel strike can be applied, can be plated.

In many instances, the object to be plated is a worn part which, in use, has become rusty, greasy, scratched or otherwise incompatible with immediate plating. Therefore, the object may be pre-treated so that a properly adherent and sufficiently uniform plated coating may be achieved.

Before these objects are electroplated they can first be optionally prepared and treated by employing one or more conventional well-known techniques. Whether or not the object should be pre-treated would depend upon the condition of the object.

Specifically, if the object contains particles or scales of rust on the surface, these should be removed prior to electroplating. Accordingly, if rusting or scaling is present, the objects are first tumbled so that they may attain a smoothened configuration. The tumbling is a type of abrasion which removes heavy accumulation of unwanted surface irregularities and impurities. The objects may thereafter be degreased in any conventional manner. Optionally, after the objects have been degreased they can be heat treated. Once the object has been sufficiently pre-treated, if necessary, by the optional pre-treatment steps, the object is ready to be plated.

Figure 1:
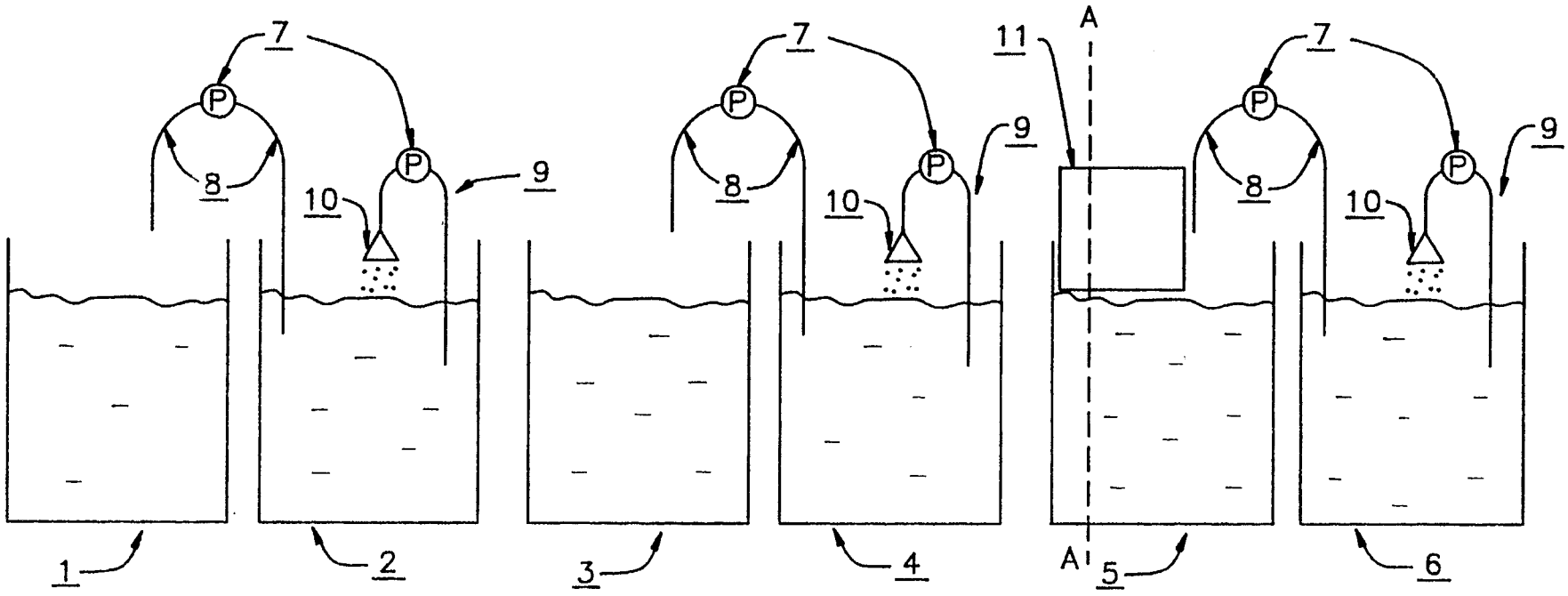
FIG. 1 shows a schematic view of one of the embodiments of the apparatus and concommitant process of the present invention.

FIG. 1 shows one embodiment of the present apparatus and process and the references in the detailed description which follows are to FIG. 1.

As one pre-electroplating step, the object is usually or typically hot electrocleaned in order to remove any additional grease and dirt which may be adhered to the object. This is accomplished by immersing the object in a hot electroclean solution which is contained within a single, stagnant hot electroclean bath (1). The electroclean solution comprises a mixture or solution of base or caustic, e.g. of sodium hydroxide, and water. Those skilled in the art are familiar with the various concentrations (weight/volume) of sodium hydroxide/water which may be used as the electroclean solution. For most purposes, a solution of 10–80%, preferably 25–75% more preferably 40–60% and especially preferably 50% weight/volume can be used. The object is tumbled in the electroclean solution while a reverse DC current of a predetermined voltage and amperage is applied. Generally, the voltage is in the range of about 5–20 volts, preferably in the range of about 5–10 volts and especially preferably in the range of about 6–9 volts. Generally, the amperage is in the range of about 100 to 400 amps, preferably in the range of about 100 to 200 amps, and especially preferably in the range of about 100 to 150 amps. The object should be permitted to remain within the electroclean solution for a period time sufficient to remove any additional grease and dirt. In general, a time of about 5 minutes to about 20 minutes is sufficient, depending of course on the size and surface characteristics of the object. Also, preferably, the object to be plated is contained in a rotating barrel within the electroclean bath and tumbled to effect more efficient contact with the electroclean solution.

A suitable electrocleaning solution is commercially available under the name OAKITE 90, which can be purchased from Oakite Corporation, Berkeley Heights, N.J. In the practice of the process of the present invention with the apparatus of the present invention, the electroclean bath (1) is filled with a sufficient amount of the appropriate hot electroclean solution so that the object may be immersed therein.

After being electrocleaned, the object is removed from the electrocleaning solution and is rinsed in the single, stagnant rinse bath (2) associated with the electroclean bath. The rinse bath (2) is filled with a sufficient amount of water, at the outset of the process, so that the object may be immersed therein.

During operation of the process , "dragout" of the electroclean bath is carried over into the single, stagnant rinse bath. Over the course of time, the single, stagnant rinse bath attains a chemical composition, i.e. basicity, which is substantially identical to that of the electroclean bath. In this regard, "substantially identical" means that the concentration of the base in the rinse bath (weight/volume) approaches that of the electroclean bath, and is at least about 50%, preferably is at least about 75% and especially preferably is at least about 90% of the concentration in the electroclean bath. In some instances, it may be that the concentration of the base in the rinse bath exceeds that in the electroclean bath. This may come about when the electroclean bath has been depleted to some degree and has not been replenished while, at the same time, the rinse bath has been subject to prolonged conditions of "dragout".

"Substantially identical" also means, in an alternative, that the pH of the rinse bath approaches or, under conditions just mentioned, became more basic than the pH of the electroclean bath. As noted above, the electroclean bath is usually basic. The pH of the electroclean bath is usually in the range of about 10 to about 14, preferably in the range of about 10 to about 12, and especially preferably in the range of about 11 to about 12. Once the process has been in operation, it has been found that the pH of the rinse bath associated with the electroclean solution becomes basic relatively quickly and within a few plating cycles is in excess of about pH 10–11. Within about 4–5 five days the pH is in excess of about 12. Therefore, in this regard, "substantially" identical means that the pH of the rinse bath is within about 2 pH units of the pH of the electroclean bath, is preferably within about 1pH unit of the pH of the electroclean bath, is especially preferably within about 0.5 pH units of the electroclean bath and most preferably is within about 0.1 to about 0.5 pH units of the electroclean bath. In some instances, the rinse bath may be more basic, i.e. have a higher pH, than the electroclean bath.

In an alternative and preferred embodiment of the present process and apparatus, it may be desirable to replace or replenish the "dragout" from the electroclean bath with solution from the rinse bath associated therewith. This is especially so when the chemical composition of the rinse bath associated with the electroclean bath becomes substantially identical to that of the electroclean bath.

The replacement or replenishment of the electroclean bath with untreated solution from the rinse bath can be accomplished through the use of any appropriate return means, including, for example, the manual use of a bucket. In a preferred embodiment of the present apparatus, the rinse bath will have associated with it return means comprised of a pump (7) and ingress and egress lines (8) which can be made of any suitable tubing or piping. The reduction in volume of rinse bath caused by replenishment of the electroclean bath (or evaporation from the rinse bath) can be made up by the addition of water to the rinse bath.

As can be seen from the foregoing, the chemical recovery and reuse of the chemicals involved in the electroclean bath and associated rinse bath of the present process and apparatus is close to 100%. The only chemical additives which are necessary to replace are those actually consumed by the electroclean step of the process (e.g. NaOH).

In addition, the electroclean bath and associated rinse bath are essentially "self-contained". In this regard, "self-contained" is taken to mean that there is no waste water produced as effluent from the process and apparatus. Only water and/or base are added to the apparatus, if and when necessary.

After the object has been treated with the electroclean solution in the electroclean bath and rinsed, the object may optionally be once again tumbled in the manner heretofore described, if additional grease or dirt removal is required.

Because the electroplating solution is acidic, the object, which becomes alkaline after treatment with the electrocleaning solution, is usually acid activated to avoid disturbing the pH of the electroplating solution. The object is acid activated by immersing it into an acidic solution. The acid activating solution in a zinc plating process and apparatus will usually be comprised of hydrochloric acid, while in a cadmium plating process it will usually be comprised of sulfuric acid.

In the practice of the process of the present invention with the apparatus of the present invention, the acid activator bath (3) is filled with a sufficient amount of the appropriate acid solution so that the object may be immersed therein.

As mentioned above, in a zinc plating process and apparatus the acid activator bath will usually be comprised of hydrochloric acid, while in a cadmium plating process and apparatus the acid activator bath will usually be comprised of sulfuric acid. Variations on the compositions of the acid activator bath for both zinc and cadmium plating process and apparatus are known to those skilled in the art. Other acid activator baths which are employed when plating metals other than zinc and cadmium are likewise known to those skilled in the art.

The acid activator bath can be of any concentration of acid which, combined with the length of time the object is immersed therein, is sufficient to at least partly counteract the alkaline effects of any residue remaining from the immersion of the object in the electrocleaning bath or sufficient to activate the object to be plated to be more receptive to electroplating.

Thus, if the acid activator bath is of a lower concentration of acid, then the immersion time will normally be longer, while if the acid activator bath is of a higher concentration of acid, then the immersion time can be shorter. All such variations of the concentration of the acid activator bath are well within the knowledge of those skilled in the art. Thus, the concentration may be varied based upon the size and configuration of the object to be plated, the volume of throughput of objects through the process and apparatus, the speed of throughput of objects through the process and apparatus, the concentration of the base in the electrocleaning solution, and the like. All such variations in process and apparatus parameters and the resulting effect upon the desired or operating concentration of the acid activator bath are within the knowledge of those skilled in the art, or are achievable without undue experimentation.

In practice, any concentration of acid, as noted above, can be employed. However, it has been found that an acid to water ratio of between 1:10 and 10:1 (based upon standard commercially available concentrated hydrochloric or sulfuric acid), preferably in the ratio of about 1:4 and 4:1, more preferably in the ratio of about 1:3 to 3:1, especially preferably in the ratio of about 1:2 to 2:1 and most preferably in the ratio of about 1:1, are useful in the process and apparatus of the present invention. The pH of the acid activator bath is usually below about 4, preferably in the range of from less than about 1 to about 3, more preferably in the range of from less than about 1 to about 2, and most preferably from less than about 1 to about 1.5.

In the plating processes and apparatuses known in the prior art, there is usually associated with the acid activator bath a flowing type rinse bath or series of rinse baths which are utilized to remove excess acidic solution from the objects to be plated due to dragout from the acid activator bath.

Applicants have found that the process and apparatus of the present invention can be greatly simplified through the use of a single, stagnant post-activator rinse bath (4). This single, stagnant rinse bath is of a type and character similar to the single, stagnant rinse bath associated with the electroclean bath. For example, the post-activator rinse bath, over the course of time and as a result of "dragout" from the acid activator bath, attains a chemical composition, i.e. acidity, which is substantially identical to that of the acid activator bath. In some instances, it may be that the concentration of the acid in the rinse bath exceeds that in the acid activator bath. "Substantially identical" as used with respect to the post-activator rinse bath has meanings as described in relation to chemical composition and pH ranges with respect to the post-electroclean rinse bath.

In an alternative and preferred embodiment of the present process and apparatus, it may be desirable to replace the "dragout" from the acid activator bath with solution from the post-activator rinse bath. This is especially so when the chemical composition of the post-activator rinse bath becomes substantially identical to that of the activator bath.

The replacement or replenishment of the acid activator bath with solution from the post-activator rinse bath can be accomplished through return means similar to those described with respect to the post-electroclean rinse bath, above, with the reduction in the post-activator rinse bath being made up through the addition of a suitable diluent, e.g., water, to the rinse bath. Thus, the acid activator bath and post-activator rinse bath are also self-contained as that term has been used in conjunction with the electroclean bath and post-electroclean rinse bath.

In an especially preferred embodiment, the post-activator rinse bath can be eliminated entirely. In this embodiment of the present process and apparatus, the object to be plated is removed from the acid activator bath and immersed in the electroplating bath, without rinsing . When removed from the acid activator bath, the object to be plated will have the excess acid activator solution removed from it by, e.g. , allowing the excess to drip or run back into the acid activator by gravity, by spinning, by shaking and the like. In this embodiment, though the acid activator bath is still self-contained, it may be necessary to periodically replace acid activator solution lost through evaporation and "dragout" with fresh solution directly into the acid activator bath.

It has been found that the objects plated suffer no loss in quality of the plated surface when the post-activator rinse bath is eliminated.

Once the object has been electrocleaned and acid activated, if necessary, in the manner heretofore described, it is ready to be electroplated.

In the practice of the process of the present invention with the apparatus of the present invention, the electroplating bath (5) is filled with an amount of an appropriate electroplating solution which is sufficient to immerse the object to be plated therein.

In general, the electroplating solution is comprised of a quantity of the metal to be plated dissolved in solution, e.g. as an aqueous solution of a metal salt or as an acidic solution of the dissolved metal, per se. Also included in the electroplating solution may be stabilizers and buffers which serve to maintain the metal to be plated in a dissolved state under electroplating conditions and/or which maintain the proper pH of the electroplating solution under electroplating conditions. Those skilled in the art are familiar with the compositional and other requirements of electroplating solutions for use in electroplating processes and apparatuses, and the manner of preparing and/or varying a particular electroplating solution to be adapted to a particular process and/or apparatus.

The electroplating solution for a zinc electroplating process may comprise a suitable amount of a zinc salt, e.g. zinc chloride, dissolved in water, or a suitable amount of zinc metal dissolved in acid and diluted with water. The electroplating solution will also usually contain certain other components such as electrolytes (to aid in carrying the high currents), stabilizers and buffers, e.g. potassium chloride and boric acid. The electroplating solution may also optionally contain brighteners.

The electroplating solution for a cadmium electroplating process may comprise a cadmium salt, e.g. cadmium oxide dissolved in water or an amount of cadmium metal dissolved in acid and diluted. The solution will also usually contain electrolytes, stabilizers and buffers and, optionally, brighteners as well.

Generally, the electroplating bath is kept at or above ambient temperatures, usually in the range of 70–90° F., preferably in the range of 75–85° F. and especially preferably in the range of about 80° F. In some instances, due to the concentration of dissolved materials in the electroplating solution or due to a lowering of the operating temperature, crystallization of the salts may occur. This can be overcome by increasing the operating temperature.

In most cases, heat is generated by the current applied to the electroplating solution and this heat is sufficient to bring the operating temperature within the desired range. Experience with barrel plating installations indicates that some cooling of the electroplating solution may be required. In rack plating installations cooling may be required if the current per gallon is above about 1.5 amps. Whether or not cooling is required is also a function of the ability of the electroplating bath to dissipate heat to the environment by radiation, which in turn is dependent to some degree on the configuration of the tank which holds the electroplating bath. If cooling is required or desired, various cooling means with their respective mode of operation, e.g. graphite heat exchanger, water-cooled titanium coils or water-cooled plastic coils, may be used. The surface area of the cooling means depends upon heat exchange conditions between the bath and the cooling means and may be varied accordingly. Such variations are well within the knowledge of those skilled in the art.

The rate of deposition of plating the metal onto the object to be plated is in part a function of the current density in the electroplating bath. In most plating operations, current densities up to about 40 amps per square foot of the surface area of the component to be plated can be used. Lower current densities are used for the most part, with current densities in the range of about 5–20 amps per square foot being used. Preferably, current densities of about 7–15 amps square foot are employed, with current densities of about 10–15 amps square foot being especially preferred. Of course, the current density used is dependent on a number of factors including the degree of cathode agitation, if any, the type and configuration of the part to be plated, the type of metal to be plated, the chemical makeup of the bath and the like. For example, in a barrel plating installation, movement of the objects to be plated is provided through rotation of the barrel and the current density employed is to some degree dependent on the speed of rotation of the barrel. Higher current densities require higher rotational speeds (and higher rotational speeds allow higher current densities) to avoid streaking or dull areas on the plated object. In rack plating installations, cathode agitation is usually required and better cathode agitation permits higher current densities (and higher current densities require higher agitation). As in barrel plating installations, if the agitation of the cathode is not sufficient for the current density employed, streaking and/or dull areas may result.

For a particular application, those skilled in the art are familiar with the variations necessary to effect a proper rate of deposition based on a combination of variables, e.g. configuration of the object to be plated, current density and cathode movement, and suitable parameters may be achieved with little or no experimentation.

Periodic filtration of the electroplating solution may be employed. Filtration is effective at times to prevent roughness of the finish on the plated part, particulary when electroplating is conducted at a high current density. When employed , the filter should preferably operate to effect at least one complete bath turnover per hour, although lower and higher turnover rates may be used. In a preferred embodiment of the present invention, the filter from the electroplating bath is removed and the plated objects have been found to be satisfactory in surface appearance under all plating conditions, whether a high or low current density has been used.

The pH of the electroplating solution is dependent upon the metal being plated, the current density and the like and may vary within a given range for any particular metal. Those skilled in the art are familiar with such variations.

In the process of the present invention where zinc is the metal to be plated, the pH of the electroplating bath is usually solution maintained as slightly acidic, i.e., within the range of about 5.0 to 6.0, preferably within the range of about 5.2 to 5.8 and especially preferably at about 5.5.

If necessary, hydrochloric acid or potassium hydroxide can be used to reduce or raise the pH of the zinc electroplating solution.

In the process of the present invention where cadmium is the metal to be plated, the pH of the solution should also be maintained as acidic, i.e. within the range of less than about 1.00 to about 2.00, preferably within the range of less than about 1.00 to about 1.50, and especially preferably of less than about 1.00 to about 1.05.

If necessary, sulfuric acid can be used to reduce the pH of the cadmium electroplating solution.

In the plating processes and apparatuses known in the prior art there is usually associated with the electroplating bath a flowing type rinse bath or series of rinse baths which are utilized to remove excess plating solution from the objects plated due to "dragout" from the electroplating bath.

Applicants have found that the process and apparatus of the present invention can be greatly simplified through the use of a single, stagnant post-electroplating rinse bath (6) into which the plated object is immersed. This single, stagnant rinse bath is of a type and character similar to the single, stagnant rinse baths associated with the electroclean bath and, optionally, with the acid activator bath. For example, the post-electroplating rinse bath, over the course of time and as a result of "dragout" from the electroplating bath, may attain a chemical composition, e.g. acidity or potassium chloride concentration, which is substantially identical to that of the electroplating bath. In some instance, it may be that the concentration of the acid or one of the chemicals in the rinse bath exceeds that in the electroplating bath. "Substantially identical" as used with respect to the post-electroplating rinse bath has similar meanings as described with respect to the post-electroclean and post-activator baths.

In an alternative and preferred embodiment of the present process and apparatus, it may be desirable to replace the "dragout" from the electroplating bath with solution from the post-electroplating rinse bath. This is especially so when the chemical composition of the post-electroplating rinse bath becomes substantially identical to that of the electroplating bath.

The replacement or replenishment of the electroplating bath with solution from the post-electroplating rinse bath can be accomplished through return means similar to those described with respect to the post-electroclean bath, above, with the reduction in the post-electroplating rinse bath being made up through the addition of a suitable diluent, e.g. water, to the rinse bath. Thus, the electroplating bath and post-electroplating rinse bath are also self-contained as that term has been used in connection with, e.g., the electroclean bath and associated rinse bath.

Figure 2:
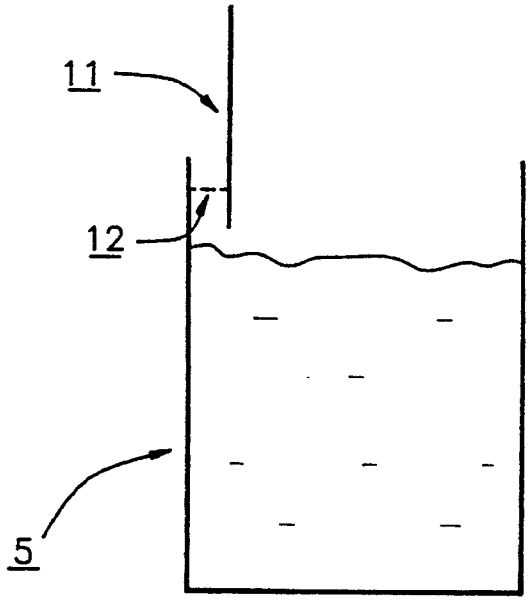
FIG. 2 shows a cross-sectional view along line A–A' in FIG. 1.
Figure 3:
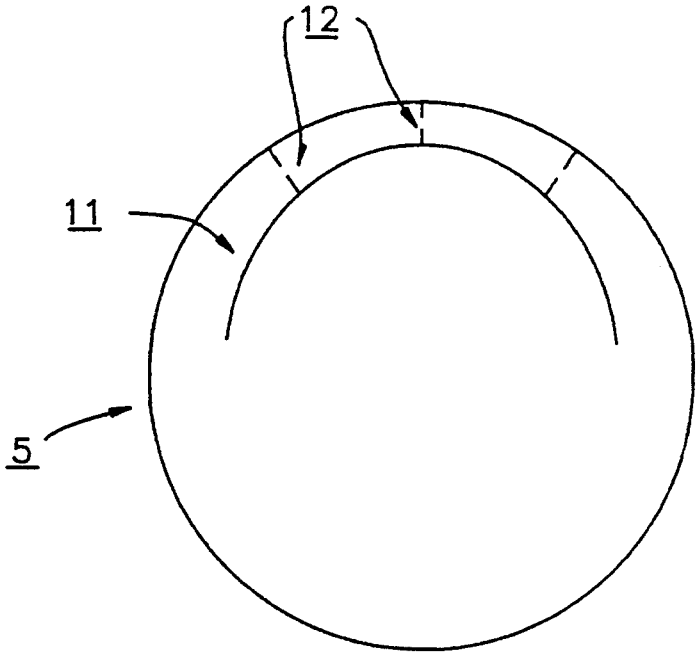
FIG. 3 shows a top plan view of the electroplating tank (5) of FIG. 1.

In an especially preferred embodiment of the present process and apparatus, the post-electroplating rinse bath can be eliminated entirely. In this embodiment, the plated part is removed from the electroclean bath and is dried. Drying can be accomplished by evaporation, by an air stream or by spinning the plated part, e.g. by centrifuge, and the like. Preferably, there are provided "recapture" means associated with the electroplating bath so that the residual electroplating bath solution spun off the plated part by centrifuge or blown off the plated part by an air stream can be "recaptured" and returned to the electroplating bath. One such simple recapture means can be comprised of, e.g., an extension (either integral with or separate from the electroplating tank) in association with, and above the level of, the electroplating bath. In practice, the object, after removed from the electroplating bath, can be blown with an air hose. The residual electroplating solution will be blown from the plated object, strike the extension and thereby be recaptured and returned to the bath. One such recapture means (11) is shown in FIGS. 2 and 3. The recapture means shown in FIGS. 2 and 3 can be an integral part of the electroplating bath tank as opposed to the separate means shown and attached with attachment means (12). Also, such recapture means can be used in conjunction with baths of the present process and apparatus other than with, or in addition to, the electroplating bath.

It should be mentioned that the tanks utilized to hold the various baths, and the recapture means, when used, should preferably be fabricated from materials which are resistant to the baths themselves. In this regard, keroseal, rubber-lined steel, polypropylene, polyethylene or polyvinyl chloride tanks and the like may be employed.

It should also be mentioned, referring to FIG. 1, that "immersion" can be effected through the use of alternate circulating means. One such alternate means is depicted in FIG. 1. Therein, in each of the post-electroclean rinse bath, the post-activator rinse bath and the post-electroplating rinse bath, there is a pump (7) associated with delivery means (9) and a spray head (10). A similar circulating means can also be included with the acid activator bath. The combination serves to draw solution from the respective baths and to spray the solution over the surface of the part, thereby "immersing" it. Although only one such circulating means has been depicted with each bath in the FIGURE, multiple circulation means may be used. Other alternate circulating means, all included within the scope of the present invention, will suggest themselves to those skilled in the art.

The invention will now be described by reference to the following examples which are intended to show representative or best embodiments of the present invention and should in no way be deemed to limit or restrict the full scope of the present invention.

DESCRIPTION OF THE PREFERRED EMBODIMENTS

Examples of zinc electroplating solutions, which have been discovered to impart the highest quality finish onto the subject to be coated, include those materials listed in Table 1 and Table 2 below.

TABLE 1

| Component | Concentration of component per 1 gallon of liquid electroplating bath |
|---|---|
| Zinc Chloride | 3.0 ounces |
| Potassium Chloride | 14.5 ounces |
| Boric Acid (Brightener) | 4.5 ounces |
| SLZ plus 26S (Brightener) | .01 quart |
| SLZ plus 35R | .03 gallon |
| Water | Amount sufficient to yield 1 gallon of solution |

Table 1 includes materials and their relative concentrations based upon a 1 gallon mixture of zinc electroplating bath solution.

TABLE 2

| Component | Concentration of component per 100 gallons of electroplating solution |
|---|---|
| Zinc Chloride | 50 lbs. |
| Potassium Chloride | 135 lbs. |
| Boric Acid | 24 lbs. |
| SLZ plus 26S (Brightener) | 1 quart |
| SLZ plus 35R (Brightener) | 3 gallons |
| Water | Amount sufficient to yield 100 gallons of solution |

Table 2 includes materials and their relative concentrations based upon a 100 gallon mixture of zinc electroplating bath solution.

On a commercial scale, the zinc electroplating solution is prepared by adding 50 gallons of water to a tank. The water is heated to a temperature of between 100°–120° F. The zinc chloride, boric acid and potassium chloride are then added into the vessel containing the heated water and are dissolved by stirring the vessel contents. The resulting solution is then permitted to cool to approximately between 80°–85° F. The cooled solution is then filtered into a clean electrocleaning tank. Thereafter, the SLZ plus 26S and SLZ plus 35R are added, both of which are available from LeaRonal, Inc., Freeport, N.Y. The tank is the filled to a final volume of 100 gallons with water.

EXAMPLE 1

The object to be electroplated is first immersed into a hot electroclean bath comprised of sodium hydroxide solution. The temperature of this bath is approximately 180° F. The concentration of the sodium hydroxide in the hot electroclean bath is approximately 33% (weight/volume). The electroclean bath has a pH of about 12.0. A reverse DC current of about 150 amps is applied at a voltage of about 8 volts. The object is allowed to remain in the electroclean bath for about 10–20 minutes.

The object is then removed from the hot electroclean bath, excess electroclean solution is allowed to drip off the object and back into the electroclean bath, and the object is immersed in the post-electroclean single, stagnant rinse bath. The temperature of this bath is ambient temperature, i.e. about 65°–70° F. The object is allowed to remain in the rinse bath about 5–10 seconds, while gently agitating the object to aid rising.

The object is then removed from this rinse bath, excess rinse solution is allowed to drip off the object and back into the rinse bath, and the object is immersed in the acid activator bath.

The acid activator bath is at ambient temperature, i.e. at a temperature of about 65°–70° F. The solution in the acid activator bath is comprised of hydrochloric acid at a dilution of about 1:1 (volume/volume). The acid activator bath has a pH of about 2.0. The object is allowed to remain in the acid activator bath for about 30 seconds, while gently agitating the object to aid in thoroughly contacting the object, which may still be alkaline, with the acid activator solution.

The object is then removed from the acid activator bath, excess acid activator solution is allowed to drip off the object and back into the acid activator bath, and the object is immersed in the electroplating bath.

The electroplating bath comprises the solution described above in Table 2 and prepared according to the description thereafter set forth.

The electroplating bath has a pH of about 5.8 and is at a temperature of about 70°–75° F. A DC current of about 100 amps is applied at a voltage of about 3–4 volts. After about 1 hour the object has a uniform, adherent, high-quality plated surface of zinc in a thickness of about 0.2 mm.

The object is then removed from the electroplating bath, excess electroplating solution is allowed to drip off the object and back into the electroplating bath, and the object is immersed in the post-electroplating single, stagnant rinse bath.

The post-electroplating single, stagnant rinse bath has a pH of about 5.5. The temperature of this bath is about 65°70° F. The object is allowed to remain in this rinse bath about 2 minutes, while gently agitating the object to aid in rinsing, and is then removed and dried.

The plated object has a zinc plated surface of a quality which is equal to that of zinc plated surfaces of the prior art processes and apparatuses. Quality control tests show that the zinc plated surfaces produced by the process and apparatus of Example 1 of the present invention can satisfy the requirements of the military and industry.

EXAMPLE 2

The process and apparatus as set forth in Example 1 are again utilized as described therein to electroplate zinc onto an object. However, "immersion" in the post-electroclean rinse bath, the post-electroplate rinse bath and the acid activator bath is accomplished by spraying the respective baths over the object through the use of the circulating means, above described.

The plated object has a zinc-plated surface of a like quality to that of Example 1.

EXAMPLE 3

The process and apparatus as set forth in Example 1 are again utilized as described therein to electroplate zinc onto an object. However, after immersion in each bath, the object is spun or shaken to effect more thorough removal of the respective solution before immersion of the object into the successive bath.

The plated object has a zinc-plated surface of a like quality to that of Example 1.

EXAMPLE 4

The process and apparatus as set forth in Example 1 are again utilized as described therein to electroplate zinc onto an object. However, after immersion in each bath, the object is immediately immersed into the successive bath without spinning or shaking the object and without allowing excess solution to drip back into each bath.

The plated object has a zinc-plated surface of a like quality to that of Example 1.

EXAMPLE 5

The process and apparatus as generally set forth in Example 1 are again utilized as described therein to electroplate zinc into an object. However, only the hot electroclean bath, the acid activator bath and electroplating bath are used. No rinse baths are utilized. In addition, each bath used has associated with it "recapture" means as described herein. After immersion in each bath, the object is blown substantially dry with an air hose and the residual, respective solution remaining on the object is returned to the respective bath via the recapture means.

The plated object has a zinc-plated surface of a like quality to that of Example 1.

TABLE 3

| Component | Concentration of component per 100 gallons of electroplating solution |
|---|---|
| Cadmium Oxide | 37.5 lbs. |
| Sulfuric Acid | 96 lbs. |
| Brightener | 8 gallons |
| Stabilizer | 3 quarts |
| Water | Amount sufficient to yield 100 gallons of solution |

Table 3 includes materials and their relative concentrations based upon a 100 gallon mixture of cadmium electroplating bath solution.

On a commercial scale, the cadmium electroplating solution is prepared by adding 50 gallons of water to a tank. The water at a temperature of between 65°-75° F. The cadmium oxide and sulfuric acid are then added into the vessel containing the water and are dissolved by stirring the vessel contents. The resulting solution is then permitted to cool to approximately between 60°-80° F. There-after, the brighteners and stabilizers are added and the solution stirred. The tank is then filled to a final volume of 100 gallons with water.

EXAMPLE 6

The object to be electroplated is first immersed into a hot electroclean bath comprised of sodium hydroxide solution. The temperature of this bath is approximately 180° F. The concentration of the sodium hydroxide in the hot electroclean bath is approximately 33% (weight/volume). The electroclean bath has a pH of about 12.0. A reverse DC current of about 100 amps is applied at a voltage of about 8 volts. The object is allowed to remain in the electroclean bath for about 10-20 minutes.

The object is then removed from the hot electroclean bath, excess electroclean solution is allowed to drip off the object and back into the electroclean bath, and the object is immersed in the post-electroclean single, stagnant rinse bath. The temperature of this bath is about 65°-70° F. The object is allowed to remain in the rinse bath about 5-10 seconds, while gently agitating the object to aid rinsing.

The object is then removed from this rinse bath, excess rinse solution is allowed to drip off the object and back into the rinse bath, and the object is immersed in the acid activator bath.

The acid activator bath is at a temperature of about 65°-70° F. The solution in the acid activator bath is comprised of sulfuric acid at a dilution of about 1:1 (volume/volume). The acid activator bath has a pH of about 1.0. The object is allowed to remain in the acid activator bath for about 30 seconds, while gently agitating the object to aid in thoroughly contacting the object, which may still be alkaline, with the acid activator solution.

The object is then removed from the acid activator bath, excess acid activator solution is allowed to drip off the object and back into the acid activator bath, and the object is immersed in the electroplating bath.

The electroplating bath comprises the solution described above in Table 3 and prepared according to the description thereafter set forth.

The electroplating bath has a pH of about 1.3 and is at a temperature of about 65°-70° F. A DC current of about 100 amps is applied at a voltage of about 3-4 volts. After about 45 minutes the object has a uniform, adherent, high-quality plated surface of cadmium in a thickness of about 0.3 mm.

The object is then removed from the electroplating bath, excess electroplating solution is allowed to drip off the object and back into the electroplating bath, and the object is immersed in the post-electroplating single, stagnant rinse bath.

The post-electroplating single, stagnant rinse bath has a pH of about 1.5. The temperature of this bath is about 65°-70° F. The object is allowed to remain in this rinse bath about 30 seconds, while gently agitating the object to aid in rinsing, and is then removed.

The plated object has a cadmium plated surface of a quality which is equal to that of cadmium plated surfaces of the prior art processes and apparatuses. Quality control tests show that the cadmium plated surfaces produced by the process and apparatus of Example 1 of the present invention can satisfy the requirements of the military and industry.

EXAMPLE 7

The process and apparatus as set forth in Example 6 are again utilized as described therein to electroplate cadmium onto an object. However, "immersion" in the post-electroclean rinse bath, the post-electroplate rinse bath and the acid activator bath is accomplished by spraying the respective baths over the object through the use of the circulating means, above described.

The plated object has a cadmium-plated surface of a like quality to that of Example 6.

EXAMPLE 8

The process and apparatus as set forth in Example 6 are again utilized as described therein to electroplate cadmium onto an object. However, after immersion in each bath, the object is spun or shaken to effect more thorough removal of the respective solution before immersion of the object into the successive bath.

The plated object has a cadmium-plated surface of a like quality to that of Example 6.

EXAMPLE 9

The process and apparatus as set forth in Example 6 are again utilized as described therein to electroplate cadmium onto an object. However, after immersion in each bath, the object is immediately immersed into the successive bath without spinning or shaking the object and without allowing excess solution to drip back into each bath.

The plated object has a cadmium-plated surface of a like quality to that of Example 6.

EXAMPLE 10

The process and apparatus as generally set forth in Example 6 are again utilized as described therein to plate cadmium onto an object. However, only the hot electroclean bath, the acid activator bath and electroplating bath are used. No rinse baths are utilized. In addition, each bath used has associated with it "recapture" means as described herein. After immersion in each bath, the object is blown substantially dry with an air hose and the residual, respective solution remaining on the object is returned to the respective bath via the recapture means.

The plated object has a cadmium-plated surface of a like quality to that of Example 6.

Accordingly, the process of electroplating can now be practiced without incurring the substantial costs relating to the treatment and disposal of the toxic rinse water. In addition, any negative impact that the toxic rinse water may have on the environment is eliminated. These advantages which are associated with the present process for electroplating exist because, in accordance with the present process, there is no need for any sort of waste disposal whatsoever.

After being electroplated, the electroplated objects are usually further treated in order to attain the most lustrous and durable finish. The objects may be centrifuged for a time period between about 2 to about 5 minutes or for as long as necessary to substantially dry the object by removing any excess liquid which might have remained thereon. In a preferred embodiment, the excess liquid resulting from the centrifuging, if any, is gathered and periodically transferred back into the electroplating bath or the rinse bath associated with the electroplating bath.

Once the object has been dried, a certain amount of potassium chloride may remain on the object. The potassium chloride can be permitted to remain on the object or can be removed therefrom. This is determined by the type of finishing process to be employed. For instance, if a standard commercial chromating finishing process is to be employed, then the potassium chloride can remain on the electroplated object. Thus, a finished product is attained by dipping the product into a standard chromate solution. However, if a silver-clear chromating finish is desired, then the potassium chloride must be removed. The residual potassium chloride can be removed from the electroplated object by immersing the object into a nitric acid bath. The nitric acid bath generally comprises a dilute solution of nitric acid, in an amount of between about 1 to about 3% (volume/volume) and water. After the object has been immersed into the nitric acid bath, it may immersed in a clear chromate solution, such as Ronabrite 101 which is available from LeaRonal, Inc., Freeport, N.Y., and then centrifuged until it is dry, at which time no further residue remains on the finished product.

While preferred embodiments and several variations of the present invention are described in detail herein, it should be apparent that the disclosure and teachings of the present invention will suggest many alternative designs to those skilled in the art.

All the patents set forth in the above description are incorporated herein by reference.

What is claimed is:

1. An improved process for electroplating a metal or alloy onto an object, including immersing said object to be plated in an electrolytic plating solution, passing an electric current through said electroplating solution to effect plated deposition of the metal or alloy onto said object to obtain a plated object, removing said plated object from the electrolytic plating solution and immersing said plated object into a post-electroplating rinse solution, wherein the improvement comprises:

(a) immersing said plated object into a post-electroplating single, stagnant rinse bath for a period of time sufficient to effect rinsing thereof;

(b) removing said plated object from the post-electroplating single, stagnant rinse bath; and (c) drying said plated object.

2. An improved process for electroplating a metal or alloy onto an object according to claim 1 wherein the chemical composition of the rinse bath is substantially identical to the chemical composition of the electroplating bath.

3. An improved process for electroplating a metal or alloy onto an object according to claim 2 wherein the concentration of at least one chemical in the rinse bath is at least about 50% of the concentration of said at least one chemical in the electroplating bath.

4. An improved process for electroplating a metal or alloy onto an object according to claim 3 wherein the chemical is a metal or alloy.

5. An improved process for electroplating a metal or alloy onto an object according to claim 2 wherein the concentration of at least one chemical in the rinse bath is at least about 90% of the concentration of said at least one chemical in the electroplating bath.

6. An improved process for electroplating a metal or alloy onto an object according to claim 2 wherein the concentration of said at least one chemical in the rinse bath exceeds the concentration of said at least one chemical in the electroplating bath.

7. An improving process for electroplating a metal or alloy onto an object according to claim 1 wherein the pH of the rinse bath is within about 2 pH units of the electroplating bath.

8. An improved process for electroplating a metal or alloy onto an object according to claim 1 wherein the metal to be plated onto the object is zinc and the pH of electroplating bath is from about 5.0 to about 6.0.

9. An improved process for electroplating a metal or alloy onto an object according to claim 1 wherein the metal to be plated onto the object is cadmium and the pH of electroplating bath is from about 1.00 to about 2.00.

10. An improved process for electroplating a metal or alloy onto an object including immersing said object to be plated in an electrolytic plating solution, passing an electric current through said electroplating solution to effect plated deposition of the metal or alloy onto said object to obtain a plated object, and removing said plated object from the electrolytic plating solution, wherein the improvement comprises:

(a) removing said plated object from said electroplating bath;
(b) removing excess electroplating solution from said plated object through the use of removal means and without the use of any rinse solution;
(c) recapturing said excess electroplating solution removed from said plated object through the use of recapture means; and
(d) returning said excess electroplating solution to said electroplating bath.

11. A process for electroplating a metal or alloy onto an object comprising the steps of:
(a) immersing said object to be plated into a hot electroclean bath for a time sufficient to effect cleaning of the object to be plated;
(b) removing said object from said hot electroclean bath;
(c) immersing said object into a post-electroclean single, stagnant rinse bath for a time sufficient to effect rinsing thereof;
(d) removing said object from said rinse bath;
(e) immersing said object into an acid activator bath for a time sufficient to activate said object for electroplating;
(f) removing said object from said acid activator bath;
(g) immersing said object into an electroplating bath;
(h) electroplating said metal or alloy onto said object under conditions suitable to plate the desired amount of said metal or alloy onto said object to obtain a plated object;
(i) removing said plated object from said electrolating bath;
(j) immersing said plated object into a post-electroplating single, stagnant rinse bath for a time sufficient to effect rinsing thereof;
(k) removing said object from said post-electroplating single, stagnant rinse bath; and
(l) drying said plated object.

12. An improved process for electroplating a metal or alloy onto an object according to claim 11 wherein the metal to be plated onto the object is a cyanide dissolvable metal.

13. An improved process for electroplating a metal or alloy onto an object according to claim 11 wherein the metal to be plated onto the object is selected from the group comprising platinum, gold, palladium, silver, nickel, steels, high carbon steels, medium carbon steels and low carbon steels.

14. A process for electroplating a metal or alloy onto an object comprising the steps of:
(a) immersing said object to be plated into a hot electroclean bath to effect cleaning of the object to be plated;
(b) removing said object from said hot electroclean bath; p1 (c) immersing said object into a post-electroclean single, stagnant rinse bath to effect rinsing thereof;
(d) removing said object from said rinse bath;
(e) immersing said object into an acid activator bath to activate said object for electroplating;
(f) removing said object from said acid activator bath;
(g) immersing said object into an electroplating bath;
(h) electroplating said metal or alloy onto said object under conditions to plate the metal or alloy onto said object to obtain a plated object;
(i) removing said plated object from said electroplating bath; and
(j) removing excess electroplating solution from said plated object without the use of any rinse bath and drying said plated object.

15. In a process for electroplating a metal or alloy onto an object including immersing said object to be plated in an electrolytic plating solution, passing an electric current through said electroplating solution to effect plated deposition of the metal or alloy onto said object to obtain a plated object, removing said plated object from the electrolytic plated solution, rinsing excess electrolytic plating solution from said plated object, and drying said plated object, the improvement comprising removing said plated object from the electroplating solution and drying said plated object without rinsing excess electrolytic plated solution from said plated object.

16. In an apparatus for electroplating a metal or alloy onto an object, said apparatus comprising an electroclean bath having associated therewith a rinse bath, the improvement comprising utilizing a single, stagnant rinse bath having a chemical composition substantially identical to the chemical composition of the electroclean bath as the rinse bath associated with the electroclean bath.

17. An apparatus as claimed in claim 16, wherein the electroclean bath is a stagnant electroclean bath.

18. In an apparatus for electroplating a metal or alloy onto an object, said apparatus comprising an acid activator bath having associated therewith a rinse bath, the improvement comprising utilizing a single, stagnant rinse bath as the rinse bath associated with the acid activator bath.

19. In an apparatus for electroplating a metal or alloy onto an object, said apparatus comprising an electroplating bath having associated therewith a rinse bath, the improvement comprising utilizing a single, stagnant rinse bath as the rinse bath associated with the electroplating bath.

20. In an apparatus for electroplating a metal or alloy onto an object, said apparatus comprised of electroclean and electroplating baths and having associated with each such bath a rinse bath, the improvement comprising utilizing single, stagnant rinse bath having a chemical composition substantially identical to the chemical composition of the electroclean and electroplating baths, respectively, as each such associated rinse bath.

21. An apparatus as claimed in claim 20, wherein the electroclean bath is a stagnant electroclean bath.

22. In an apparatus for electroplating a metal or alloy onto an object comprising an electroclean bath, an acid activator bath and an electroplating bath, each such bath normally having associated therewith a rinse bath, the improvement comprising utilizing no rinse bath associated with any of the electroclean bath, the acid activator bath or the electroplating bath.

23. An apparatus as claimed in claim 22 further comprising means for immersing and removing the object from each of the electroclean bath, acid activator bath and the electroplating bath.

24. A process for electroplating a metal or alloy onto an object comprising the steps of:
(a) immersing said object to be plated into a hot electroclean bath to effect cleaning of the object to be plated;
(b) removing said object from said hot electroclean bath;
(c) immersing said object into an acid activator bath to activate said object for electroplating;

(d) removing said object from said acid activator bath;
(e) immersing said object into an electroplating bath;
(f) electroplating said metal or alloy onto said object under conditions to plate said metal or alloy onto said object to obtain a plated object;
(g) removing said plated object from said electroplating bath; and
(h) drying said plated object, wherein no rinsing of electroclean, acid activator, or electroplating bath solution from the object is performed.

25. An improved process for electroplating a metal or alloy onto an object, including immersing said object to be plated into a hot electroclean solution, electrocleaning said object, removing said object from said hot electroclean solution, immersing said object into a post-electroclean rinse bath, and removing said object from said post-electroclean rinse bath, wherein the improvement comprises:
(a) immersing the object to be plated into a post-electroclean single, stagnant rinse bath to effect rinsing thereof;
(b) removing said object from said rinse bath; and
(c) allowing excess rinse solution to return to said post-electroclean single, stagnant rinse bath.

26. An improved process for electroplating a metal or alloy onto an object according to claim 25 wherein the chemical composition of the rinse bath is substantially identical to the chemical composition of the electroclean bath.

27. An improved process for electroplating a metal or alloy onto an object according to claim 26 wherein the concentration of at least one chemical in the rinse bath is at least about 50% of the concentration of said at least one chemical in the electroclean bath.

28. An improved process for electroplating a metal or alloy onto an object according to claim 27 wherein the chemical is a base.

29. An improved process for electroplating a metal or alloy onto an object according to claim 26 wherein the concentration of at least one chemical in the rinse bath is at least about 90% of the concentration of said at least one chemical in the electroclean bath.

30. An improved process for electroplating a metal or alloy onto an object according to claim 26 wherein the concentration of at least one chemical in the rinse bath exceeds the concentration of said at least one chemical in the electroclean bath.

31. An improved process for electroplating a metal or alloy onto an object according to claim 26 wherein the concentration of at least one chemical in the rinse bath exceeds the concentration of said at least one chemical in the acid activator.

32. An improved process for electroplating a metal or alloy onto an object according to claim 25 wherein the pH of the rinse bath is within about 2 pH units of the electroclean bath.

33. An improved process for electroplating a metal or alloy onto an object according to claim 25 wherein the pH of the rinse bath is within about 0.1 to about 0.5 pH units of the electroclean bath.

34. An improved process for electroplating a metal or alloy onto an object according to claim 25 wherein the pH of the electroclean bath is between about 10–14.

35. An improved process for electroplating a metal or alloy onto an object including, immersing said object to be plated into a hot electroclean solution, electrocleaning said object, removing said object from said hot electroclean solution, and immersing said object into a post-electroclean rinse bath, wherein the improvement comprises:
(a) removing said object from said hot electroclean bath;
(b) removing excess hot electroclean solution from said object through the use of removal means;
(c) recapturing said excess hot electroclean solution removed from said object through the use of recapture means; and
(d) returning said excess hot electroclean solution to said hot electroclean bath.

36. An improved process for electroplating a metal or alloy onto an object, including immersing the object to be plated into an acid activator bath, removing said object from said acid activator, immersing said object into a post-activator rinse bath, and removing said object from said post-activator rinse bath, the improvement comprising:
(a) immersing the object to be plated into a post-activator single, stagnant rinse bath to effect rinsing thereof;
(b) removing said object from said rinse bath; and
(c) allowing excess rinse solution to return to said post-activator rinse bath.

37. An improved process for electroplating a metal or alloy onto an object according to claim 36 wherein the chemical composition of the rinse bath is substantially identical to the chemical composition of the acid activator bath.

38. An improved process for electroplating a metal or alloy onto an object according to claim 37 wherein the concentration of at least one chemical in the rinse bath is at least about 50% of the concentration of said at least one chemical in the acid activator bath.

39. An improved process for electroplating a metal or alloy onto an object according to claim 38 wherein the chemical is an acid.

40. An improved process for electroplating a metal or alloy onto an least object according to claim 37 wherein the concentration of at least one chemical in the rinse bath is at least about 90% of the concentration of said at least one chemical in the acid activator bath.

41. An improved process for electroplating a metal or alloy onto an object according to claim 36 wherein the pH of the rinse bath is within about 2 pH units of the acid activator bath.

42. An improved process for electroplating a metal or alloy onto an object according to claim 41 wherein the ratio of acid to water in the activator bath is between 1:10 and 10:1.

43. An improved process for electroplating a metal or alloy onto an object according to claim 41 wherein the pH of the acid acid activator bath is below about 4.

44. An improved process for electroplating a metal or alloy onto an object, including immersing the object to be plated into an acid activator bath, removing said object from said acid activator bath, immersing said object into a post-activator rinse bath, and removing said object from said post-activator rinse bath, the improvement comprising:
(a) removing said object from said acid activator bath;
(b) allowing excess acid activator solution to return to said acid activator bath; and
(c) immersing said object into an electroplating bath.

45. An improved process for electroplating a metal or alloy onto an object, including immersing the object to be plated into an acid activator bath, removing said object from said acid activator bath, immersing said object into a post-activator rinse bath, and removing said object from said post-activator rinse bath, the improvement comprising:

(a) removing said object from said acid activator bath;

(b) removing excess acid activator solution from said object through the use of removal means;

(c) recapturing said excess acid activator solution removed from said object through the use of recapture means; and (d) returning said excess acid activator solution to said acid activator bath.

* * * * *